US009895033B2

(12) United States Patent
Keily et al.

(10) Patent No.: US 9,895,033 B2
(45) Date of Patent: Feb. 20, 2018

(54) DISPENSER APPARATUS WITH DAMPER FOR DISPENSING PAPER TOWELING

(71) Applicant: DISPENSING DYNAMICS INTERNATIONAL, City of Industry, CA (US)

(72) Inventors: Joel P. Keily, Corona, CA (US); Charles Parkin Davis, Torrance, CA (US); Orlando Pedro Ochoa, Sr., Walnut, CA (US)

(73) Assignee: Dispensing Dynamics International, LLC, City of Industry, CA (US)

( * ) Notice: Subject to any disclaimer, the term of this patent is extended or adjusted under 35 U.S.C. 154(b) by 573 days.

(21) Appl. No.: 14/561,320

(22) Filed: Dec. 5, 2014

(65) Prior Publication Data

US 2016/0157682 A1 Jun. 9, 2016

(51) Int. Cl.
*B65H 23/18* (2006.01)
*A47K 10/38* (2006.01)

(52) U.S. Cl.
CPC ..... *A47K 10/38* (2013.01); *A47K 2010/3863* (2013.01)

(58) Field of Classification Search
CPC ..... A47K 10/38; A47K 10/40; A47K 10/24; A47K 10/26; A47K 10/34; A47K 10/36; A47K 2010/3675; A47K 2010/3863
See application file for complete search history.

(56) References Cited

U.S. PATENT DOCUMENTS

| | | | | |
|---|---|---|---|---|
| 5,868,343 | A * | 2/1999 | Granger | A47K 10/3643 225/14 |
| 7,500,420 | B2 | 3/2009 | Cvjetkovic et al. | |
| 8,444,080 | B2 * | 5/2013 | Hagleitner | A47K 10/3656 242/423 |
| 2015/0374181 | A1 * | 12/2015 | Morand | A47K 10/38 242/423 |

* cited by examiner

*Primary Examiner* — William A. Rivera
(74) *Attorney, Agent, or Firm* — Thomas R. Lampe

(57) ABSTRACT

Apparatus for dispensing paper toweling from a roll of paper toweling includes a rotary damper resisting formation of overspin slack in the paper toweling resulting from a pulling force applied to the paper toweling. Control mechanism changes the rotary damper from an operative condition to an inoperative condition responsive to reduction of the diameter of the roll of paper toweling.

12 Claims, 5 Drawing Sheets

DISPENSER APPARATUS WITH DAMPER FOR DISPENSING PAPER TOWELING

TECHNICAL FIELD

This invention relates to dispenser apparatus for dispensing paper toweling from a roll thereof.

BACKGROUND OF THE INVENTION

It is known generally to provide a damping system in roll paper towel dispensers to absorb the shock that occurs when roll overspin slack is taken up, thereby preventing "tabbing" during use of the dispenser.

Tabbing occurs when a piece of towel tears off the sheet when a user grasps and pulls the paper. Tabbing may occur with one or two hand pulls. Papers that absorb water at the greatest rate are most likely to tab. The rate of water absorbency varies by paper manufacturer and grade. Premium grade papers tend to absorb water the quickest and are generally harder to cut which leads to a higher rate of tabbing.

Tabbing takes place when overspin slack is taken up. A "shock" is present at the moment the overspin slack is exhausted. The shock occurs because the stationary roll towel must begin rotating at the moment the overspin slack is exhausted. The shock is greatest with full rolls and diminishes as the roll is exhausted.

U.S. Pat. No. 7,500,420, issued Mar. 10, 2009, discloses dispenser apparatus for dispensing paper toweling that includes structure for damping forces applied to a roll of paper toweling when overspin slack is taken up and wherein the timing of a cutter blade incorporated in the dispenser apparatus is modified to reduce peak pull force during dispensing. A biased damping roller is displaceable by the toweling when the toweling is pulled to take up the slack and maintain the toweling in taut condition between the end being pulled and the roll.

Paper companies continue to introduce bigger, heavier rolls with smaller core diameters and in some cases proprietary roll support plugs. Paper companies, for example, currently are making paper toweling rolls 10 inches in diameter and having 1,500 feet of paper.

This creates an even greater challenge when dealing with overspin. The biased damping roller approach disclosed in U.S. Pat. No. 7,500,420 may not be adequate to effectively control overspin in certain bigger, heavier rolls.

Overspin can create the following negative dispensing issues for dispensers including self cutting mechanisms, such as drum mounted tear blade systems, an example of which is disclosed in U.S. Pat. No. 7,500,420.

Among the problems is double sheeting. This can happen in two ways. One, on fast pulls the drum can over-rotate, dispensing the next sheet still attached to the first.

Two, the overspun toweling has no tension against the tear blade, which can reduce cutting effectiveness.

Another problem is the tabbing discussed above caused by the shock force created to get the roll spinning.

These problems were addressed by the invention disclosed in co-pending U.S. patent application Ser. No. 14/468,440, filed Aug. 26, 2014, which includes a rotary damper operatively associated with structure of a dispenser apparatus for dispensing toweling from a roll thereof. The term "toweling" as employed therein includes paper towels and toilet tissue.

The rotary damper resists rotation of the roll during dispensing to prevent overspin.

More particularly, according to one embodiment of the invention disclosed in application Ser. No. 14,468,440, the rotary damper, which may be of any suitable type, such as a geared type or a suitable non-gear type such as a viscous shear type damper, is located at the roll support arm or other roll support.

In other embodiments of the rotary damper is at the toweling sheet support drum or at an intermediate roller of a dispenser.

Benefits of the invention of application Ser. No. 14/468,440 include (a) overspin control and (b) reduced double sheeting by preventing the mechanism from free spinning.

It has been found that with large diameter heavy rolls it is necessary to use a heavier damper to control overspin while the roll diameter is large. This can create a problem, for example when the roll diameter decreases to around 4 inches and the drum return spring of the dispenser doesn't have enough energy to overcome the frictional drag created by the damper, resulting in short tails and eventually no tails. Overspin slack formation can be a problem for virtually any type of paper toweling dispenser where toweling from large diameter rolls is subjected to pulling forces.

DISCLOSURE OF INVENTION

The present invention provides a solution to this issue by disconnecting the damper when the roll diameter decreases to a selected lower size. A damper usually isn't needed when the roll diameter has been reduced to this size because the inertia of the roll is low.

The paper toweling dispenser apparatus of the present invention is for dispensing paper toweling from a roll of paper toweling and resisting formation of paper toweling overspin slack.

The term "toweling" as employed herein includes paper towels and toilet tissue.

The apparatus includes roll support structure for supporting a roll of paper toweling with said roll of paper toweling being rotatable relative to said roll support structure when a pulling force is applied to said paper toweling.

A rotary damper is operatively associated with the roll support structure and alternatively has an operative condition wherein the rotary damper substantially or wholly prevents formation of overspin slack in the paper toweling resulting from the pulling force and an inoperative condition.

Control mechanism is operatively associated with the rotary damper to change the rotary damper from the operative condition to the inoperative condition responsive to reduction of the diameter of roll of paper toweling during dispensing of paper toweling therefrom.

Other features, advantages and objects of the present invention will become apparent with reference to the following description and accompanying drawings.

BEST MODE FOR CARRYING OUT THE INVENTION

Figure 1:
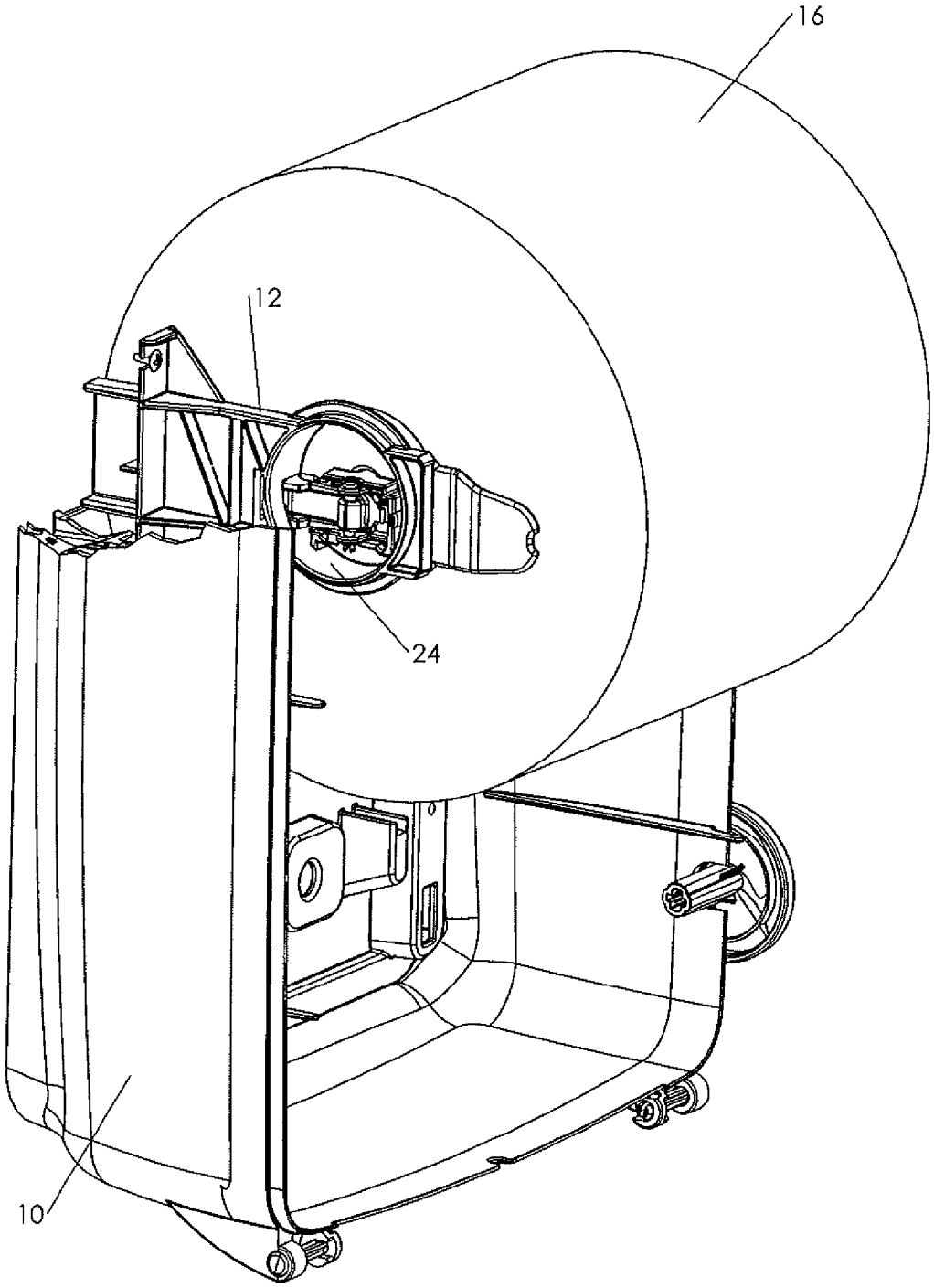
FIG. 1 is a perspective view illustrating a back cabinet portion and selected structural operating components of the dispenser apparatus of the present invention including a rotary damper on a roll support arm supporting a roll of toweling.
Figure 2:
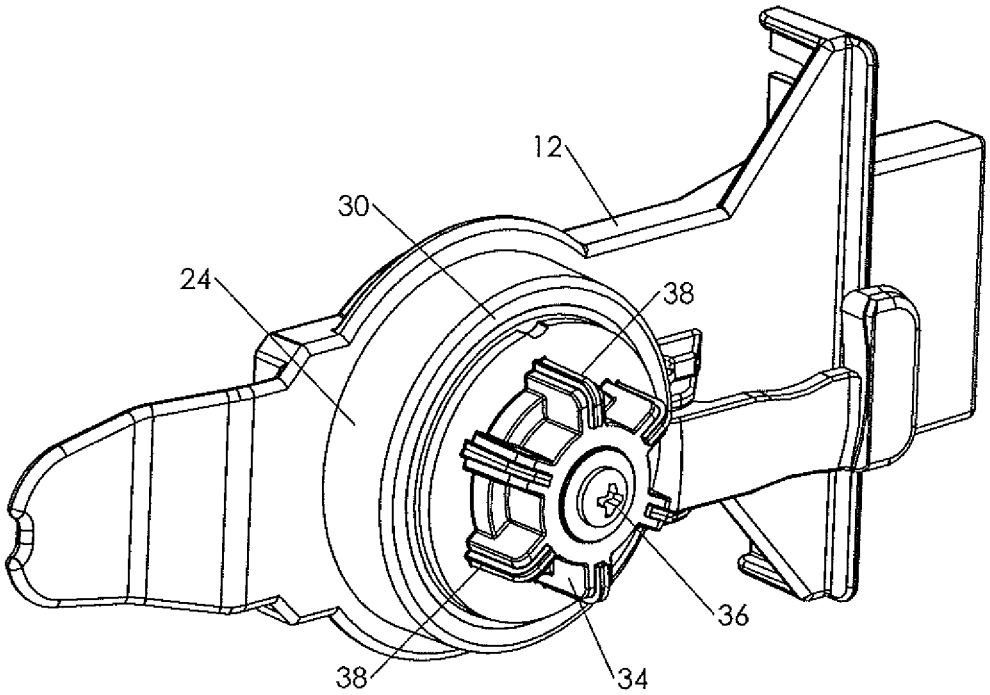
FIG. 2 is an enlarged, perspective view of the damper arm assembly of the invention including the support arm, a geared roll support hub located at the outer surface of a housing of the roll support arm, and a portion of a roll engagement member.
Figure 3:
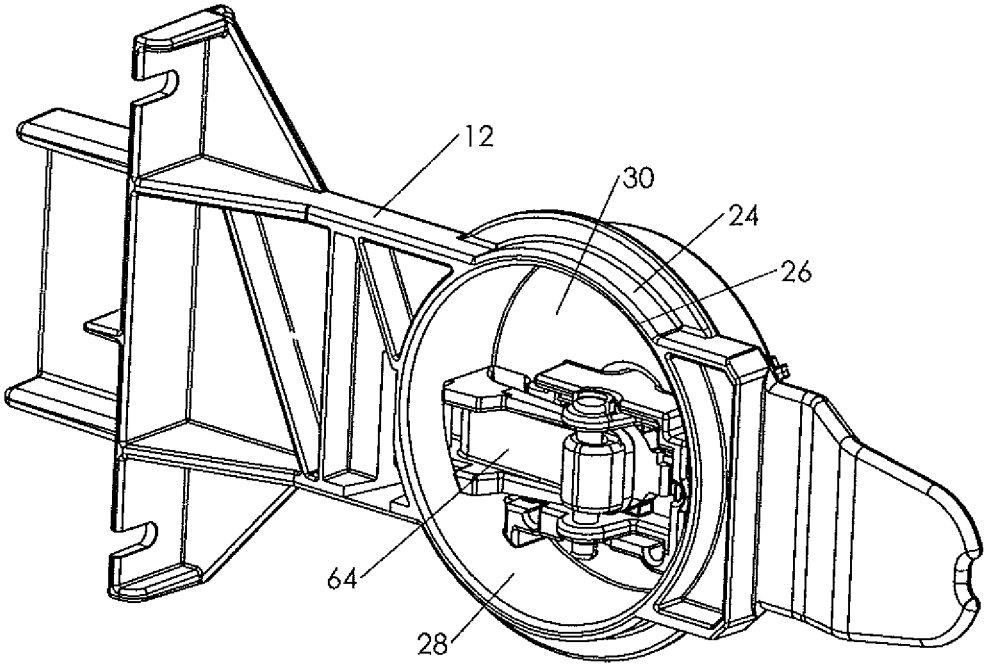
FIG. 3 is an enlarged, perspective view of the roll support arm as viewed from the outer side thereof, the housing interior of the housing accommodating a rotary damper.
Figure 4:
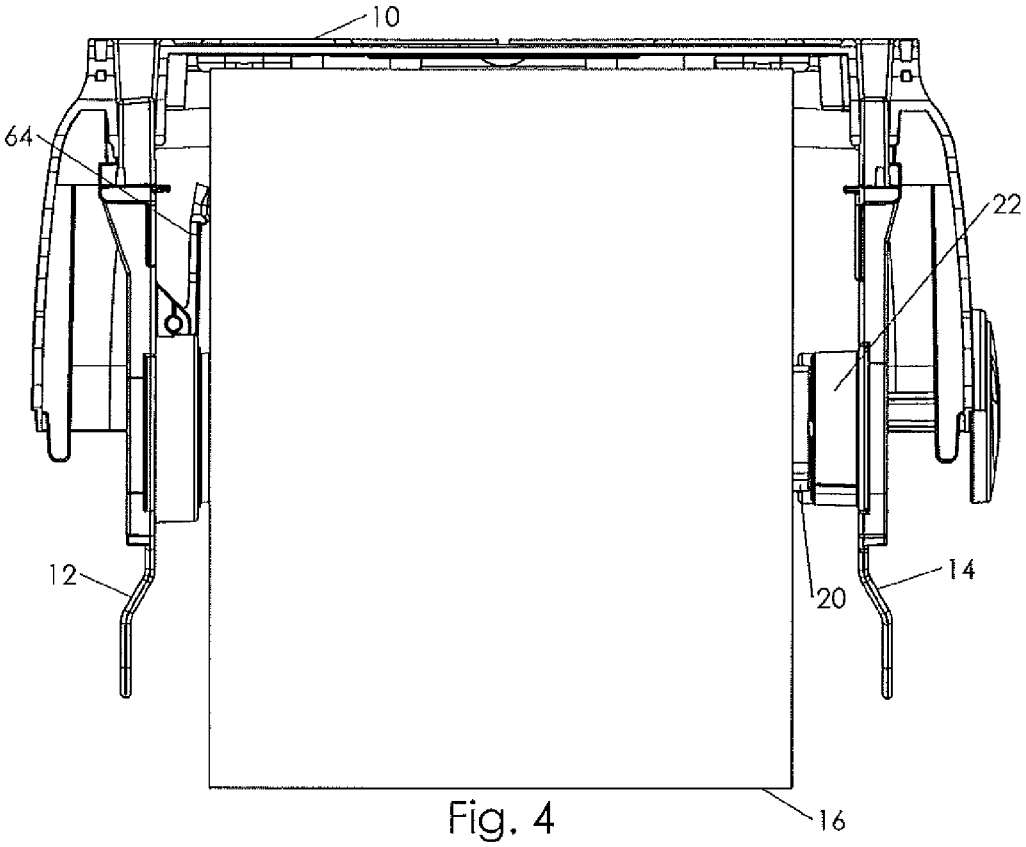
FIG. 4 is a top view in partial cross-section showing a full roll of paper toweling supported by roll support arms with a roll engagement member in engagement with an end of the full roll.

Referring now to the drawings, dispenser apparatus constructed in accordance with the teachings of the present invention is illustrated. The invention includes a cabinet 10, only the rear cabinet portion thereof being shown. Attached to the rear cabinet portion are roll support arms 12, 14 utilized to support a roll of paper toweling 16. In FIGS. 1 and 4 the roll is at full diameter condition as is the situation when the roll is positioned in the cabinet and dispensing of toweling therefrom has not yet occurred.

A plug or hub 20 (FIGS. 4 and 5) supports the end of the roll of paper toweling closest to support arm 14. The hub is positioned in a cylindrically shaped support arm portion 22 which projects inwardly from the rest of support arm 14. Hub 20 rotates with roll of paper toweling 16. Alternatively, the hub may be affixed to or part of support arm 14, with the roll rotatable thereabout.

The roll support structure at the other end of the roll is different. Support arm 12 includes a housing 24 which extends from both sides of support arm 12. The outwardly extending portion of the housing 24 has an enlarged opening 26 which communicates with a housing interior 28 surrounded by a cylindrical wall.

The inner portion of housing 24 has an end wall 30. A boss 32 extends inwardly in the direction of the roll of paper toweling and defines a screw hole passageway. A hub 34 is positioned over boss 32 and is rotatable relative thereto. A screw 36 is employed to maintain the hub 34 in place on the boss while allowing rotation thereof relative to the boss.

The hub 34 is inserted into the end of the roll of paper toweling closest to support arm 12 and rotates with the roll of paper toweling. Ribs 38 on the hub 34 help maintain the hub in fixed position relative to the roll of paper toweling. Gear teeth 44 are formed at the inner cylindrical wall of hub 34. An opening 46 is formed in end wall 30 adjacent to boss 32.

The apparatus includes a rotary damper 50 of any suitable type operatively associated with the roll support structure described above, the rotary damper alternatively having an operative condition wherein the rotary damper substantially or wholly prevents formation of overspin slack in the paper toweling within the cabinet resulting from a pulling force and an inoperative condition.

The rotary damper 50 is positioned in a damper holder 52. Damper holder 52 has guide pins 54 which engage a track structure 56 within housing interior 28. The damper holder and rotary damper are movable relative to the track within the housing 24 between a first rotary damper position when the rotary damper is in the operative condition and a second rotary damper position when the rotary damper is in the inoperative condition.

Figure 8:
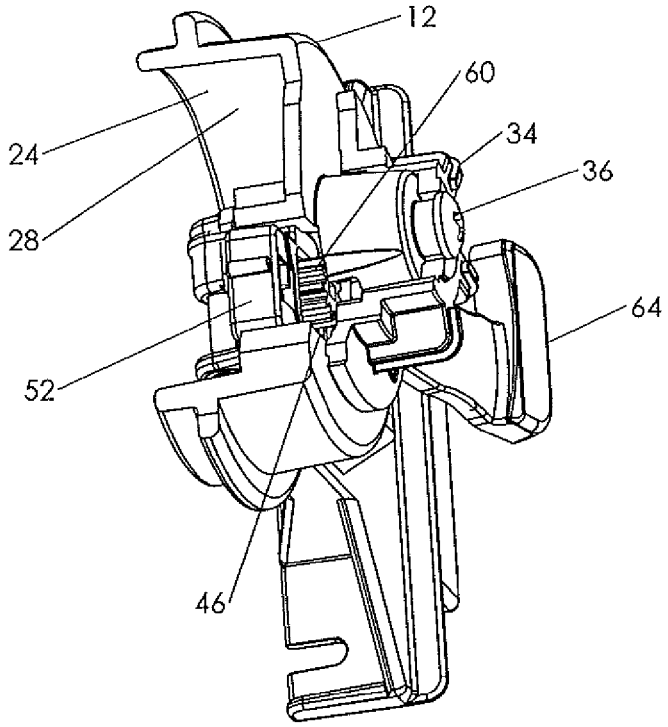
FIG. 8 is a cross-sectional, perspective view showing portions of selected components of the invention when the damper gear is disengaged from the geared hub.
Figure 9:
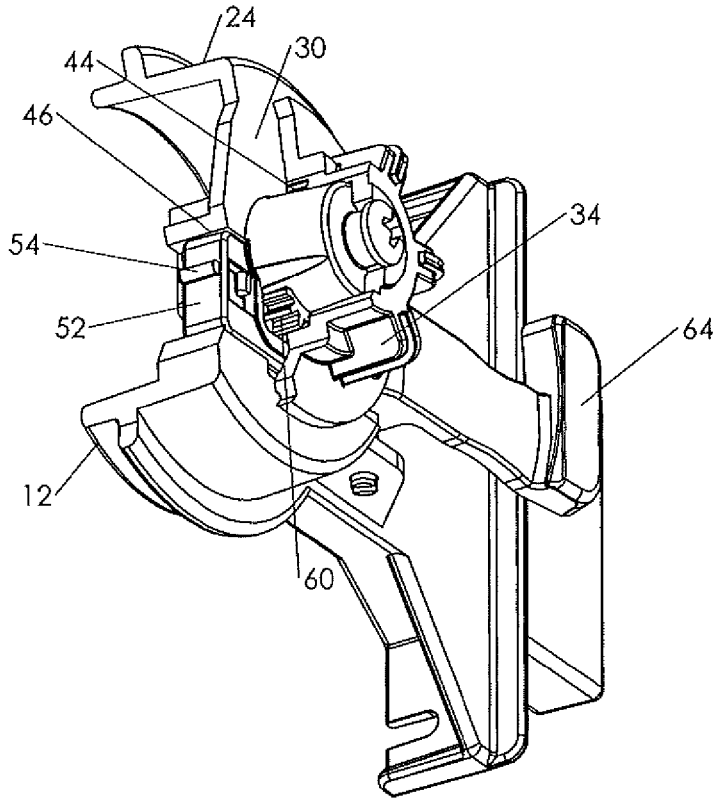
FIG. 9 is a view similar to FIG. 8, but illustrating the damper gear engaged with the geared hub.

The rotary damper 50 includes a rotary gear component 60, the rotary gear component is connected to the hub gear teeth when the rotary damper is in its operative condition. This condition is shown in FIG. 9 wherein the rotary gear component extends outwardly through opening 46. Outward movement of the damper holder and rotary damper within the housing 24 causes the rotary gear component 60 and the gear teeth 44 of hub 34 to disengage as shown in FIG. 8. Of course, when such disengagement occurs, the rotary damper will no longer resist rotation of roll of paper toweling 16 and hub 34.

Control mechanism is operatively associated with the rotary damper to change the rotary damper from the operative condition to the inoperative condition responsive to a certain amount of reduction of the diameter of the roll of paper toweling caused by dispensing of paper toweling therefrom.

The control mechanism includes a movably mounted roll engagement member engageable with the roll of paper toweling. The rotary damper (within holder 52) is movable from the operative condition to the inoperative condition when the roll engagement member senses that the diameter of the roll of paper toweling has been reduced to a predetermined value.

The roll engagement member is a double-ended engagement lever 64 engageable with the end of the roll of paper toweling. FIG. 4 shows such condition. The rotary damper and damper holder are connected by a pin 65 to the engagement lever at a location spaced from the end thereof engageable with the end of the roll of paper toweling.

Figure 5:
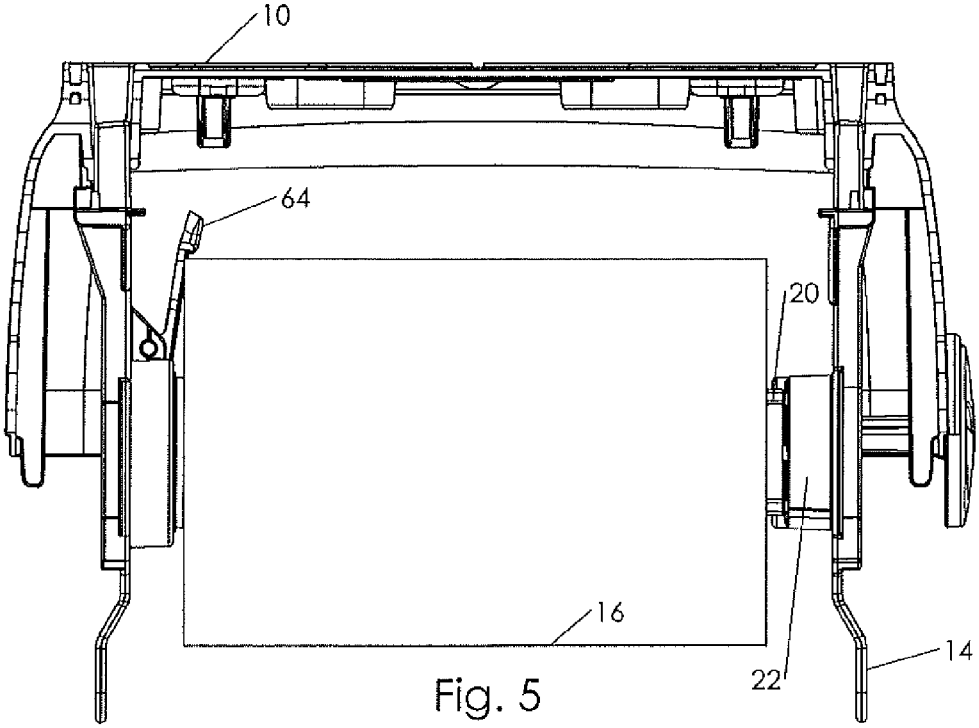
FIG. 5 is a view similar to FIG. 4, but showing the roll of paper toweling in reduced diameter, the roll engagement member no longer engaged with the end of the roll which results in disengagement of the rotary damper from roll support hub.
Figure 6:
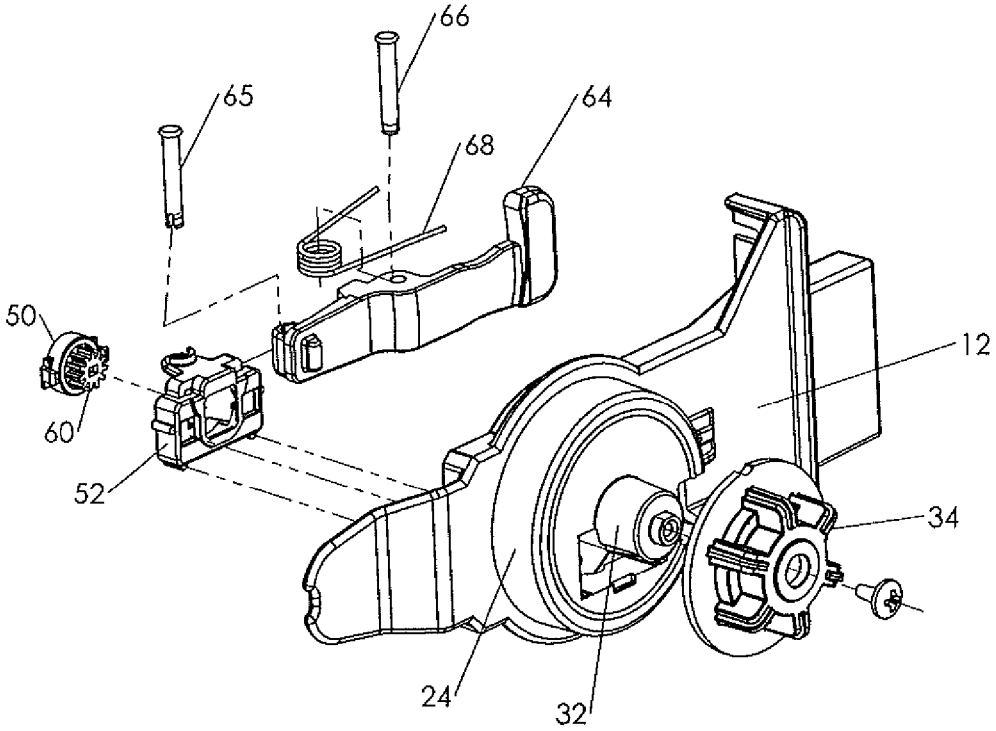
FIG. 6 is an exploded, perspective view as viewed from the inner side of the roll support arm of FIGS. 1-3 illustrating selected components including disassembled roll support hub, the rotary damper, a damper holder and roll engagement member.
Figure 7:
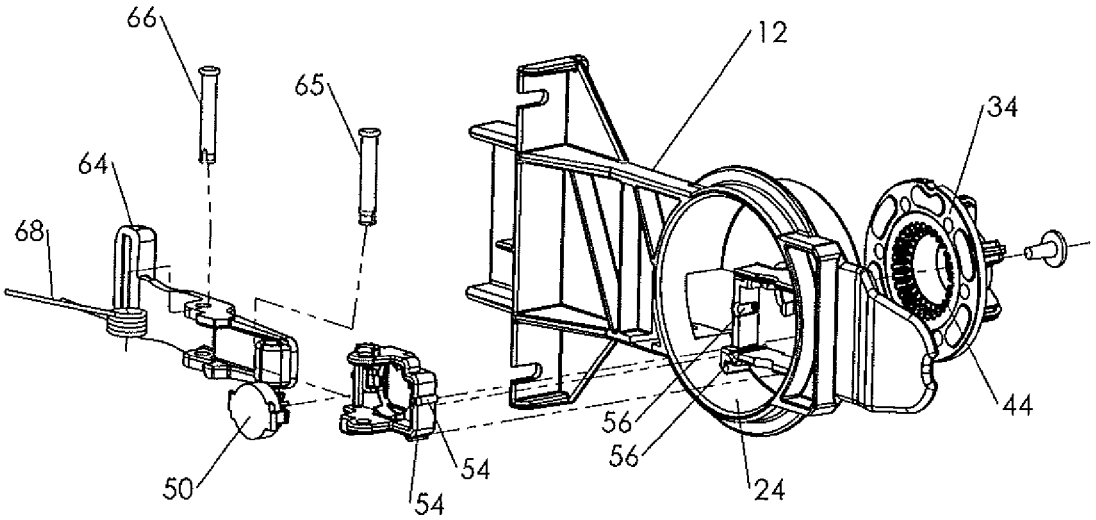
FIG. 7 is a view similar to FIG. 6, but illustrating the selected components as viewed from the outer side of the roll support arm.

The engagement lever 64 pivots about pin 66 and a spring 68 continuously urges the engagement lever for movement in a clockwise direction as shown in FIGS. 4 and 5. The spring shown is a torsion spring but any suitable type of spring, including a plastic spring integral with the engagement lever, may be utilized. When the diameter of the roll of paper toweling decreases to a certain value, for example 4.5 inches, the spring will urge the engagement lever to the position shown in FIG. 5 and cause disengagement of the rotary gear component of the rotary damper and the hub gear teeth 44. The roll of toweling will then rotate more readily.

The invention claimed is:

1. Paper toweling dispenser apparatus for dispensing paper toweling from a roll of paper toweling and resisting formation of paper toweling overspin slack, said apparatus including in combination:

a roll support structure for supporting a roll of paper toweling with said roll of paper toweling being rotatable when a pulling force is applied to said paper toweling;

a rotary damper operatively associated with said roll support structure, said rotary damper alternatively having an operative condition wherein the rotary damper substantially or wholly prevents formation of overspin slack in said paper toweling resulting from said pulling force and an inoperative condition; and a control mechanism operatively associated with said rotary damper to change the rotary damper from said operative condition to said inoperative condition responsive to reduction of the diameter of said roll of paper toweling to a predetermined value during dispensing of paper toweling therefrom, said roll support structure including a hub positioned in an end of said roll of paper toweling fixed against movement relative to said roll of paper toweling and rotatable with said roll of paper toweling, said rotary damper when in said operative condition connected to said hub and continually resisting rotation of said hub and said roll of paper toweling.

2. Paper toweling dispenser apparatus for dispensing paper toweling from a roll of paper toweling and resisting formation of paper toweling overspin slack, said apparatus including in combination:

a roll support structure for supporting a roll of paper toweling with said roll of paper toweling being rotatable relative to said roll support structure when a pulling force is applied to said paper toweling;

a rotary damper operatively associated with said roll support structure, said rotary damper alternatively having an operative condition wherein the rotary damper substantially or wholly prevents formation of overspin slack in said paper toweling resulting from said pulling force and an inoperative condition; and a control mechanism operatively associated with said rotary damper to change the rotary damper from said operative condition to said inoperative condition responsive to reduction of the diameter of said roll of paper toweling during dispensing of paper toweling therefrom, said roll support structure including a roll support arm and said rotary damper located adjacent to said roll support arm for resisting rotation of said roll of paper toweling when the rotary damper is in said operative condition, said roll support structure additionally including a hub rotatably supported by said support arm, said hub positioned at an end of said roll of paper toweling and rotatable with said roll of paper toweling, said rotary damper when in said operative condition being connected to said hub to resist rotation of said hub and said roll of paper toweling, said rotary damper including a rotary gear component and wherein said hub has a hub gear, said rotary gear component connected to said hub gear when said rotary damper is in said operative condition.

3. The paper toweling dispenser apparatus according to claim 2 wherein said control mechanism includes a movably mounted roll engagement member engageable with said roll of paper toweling.

4. The paper toweling dispenser apparatus according to claim 3 wherein said roll engagement member is operatively associated with said rotary damper, said rotary damper movable from said operative condition to said inoperative condition when said roll engagement member senses that the diameter of said roll of paper toweling has been reduced to a predetermined value.

5. The paper toweling dispenser according to claim 4 additionally including biasing structure and wherein said roll engagement member is adjacent to an end of said roll of paper toweling and is biased by said biasing structure into engagement with said end.

6. The paper toweling dispenser according to claim 5 wherein said roll engagement member is a pivotally mounted, double-ended lever, one end of said lever engageable with the end of the roll of paper toweling, said rotary damper connected to said lever at a location spaced from the end of the lever engageable with the end of the roll of paper toweling.

7. The paper toweling dispenser apparatus of claim 6 wherein said roll support arm includes a housing defining a housing interior accommodating said rotary damper.

8. The paper toweling dispenser apparatus according to claim 7 wherein said rotary damper is movable within said housing interior between a first rotary damper position when said rotary damper is in said operative condition and a second rotary damper position when said rotary damper is in said inoperative condition.

9. The paper toweling dispenser apparatus according to claim 8 including cooperative guide structure in said housing interior to guide movement of said rotary damper between said first rotary damper position and said second rotary damper position.

10. The paper toweling dispenser according to claim 9 additionally including a holder holding said rotary damper, said cooperative guide structure including track and track guide structure on said holder and said housing.

11. The paper toweling dispenser apparatus according to claim 5 wherein said biasing structure comprises a spring.

12. The paper toweling dispenser apparatus according to claim 2 wherein the rotary gear component disengages from the hub gear when said rotary damper moves from said operative condition to said inoperative condition.

* * * * *